United States Patent [19]

Simmons

[11] Patent Number: 4,538,453

[45] Date of Patent: Sep. 3, 1985

[54] METHOD AND APPARATUS FOR DETERMINING THE MASS AND MOISTURE CONTENT OF TOBACCO

[75] Inventor: Albert Simmons, High Wycombe, England

[73] Assignee: Molins PLC, London, England

[21] Appl. No.: 478,665

[22] Filed: Mar. 25, 1983

[30] Foreign Application Priority Data

Mar. 27, 1982 [GB] United Kingdom ..... 8209062

[51] Int. Cl.[3] ..... G01N 9/36; B65B 1/30

[52] U.S. Cl. ..... 73/73

[58] Field of Search ..... 73/73; 131/905

[56] References Cited

U.S. PATENT DOCUMENTS

| | | | |
|---|---|---|---|
| 2,937,280 | 5/1960 | Gilman | 73/73 X |
| 3,155,900 | 11/1964 | Hanken | 73/73 X |
| 3,155,901 | 11/1964 | Hanken | 73/73 X |
| 3,999,134 | 12/1976 | Lorenzen | 73/73 X |
| 4,170,251 | 10/1979 | Hine | 73/73 X |

FOREIGN PATENT DOCUMENTS

| | | | |
|---|---|---|---|
| 2165819 | 7/1973 | Fed. Rep. of Germany | 73/73 |
| 2449613 | 4/1976 | Fed. Rep. of Germany | 73/73 |
| 2522826 | 11/1976 | Fed. Rep. of Germany | 73/73 |
| 745917 | 3/1956 | United Kingdom | 73/73 |

*Primary Examiner*—Stewart J. Levy
*Assistant Examiner*—Joseph W. Roskos
*Attorney, Agent, or Firm*—Antonelli, Terry & Wands

[57] ABSTRACT

The mass and moisture content of tobacco forming the filler stream in a cigarette making machine are determined by a pair of capacitor plates placed on opposite sides of the filler stream forming a test capacitor (11). The test capacitor is connected in a series resonance circuit comprising an inductor (20) and a variable frequency voltage source (21) generating voltages which increase in frequency in finite steps over a range above 1 MHz. The voltage source is controlled by a processing unit (24) which also receives an indication of the voltage across the test capacitor (11). The mass and moisture content are derived from the resonance frequency of the capacitor voltage and the magnitude of said voltage at a chosen frequency, preferably the resonance frequency. Signals indicative of mass may be used to control a trimming device (7) preferably in combination with signals from a nucleonic scanner (16).

17 Claims, 3 Drawing Figures

METHOD AND APPARATUS FOR DETERMINING THE MASS AND MOISTURE CONTENT OF TOBACCO

The present invention relates to a method and apparatus for determining the mass and moisture content of tobacco by measuring its dielectric properties.

Arrangements are known for measuring the moisture content of tobacco by capacitive means in which tobacco is placed between a pair of capacitor plates forming a test capacitor of which the capacitance varies with the moisture content. The test capacitor may be connected in a balanced bridge circuit so that a change in capacitance results in the bridge becoming unbalanced by a degree related to the moisture content of the tobacco.

These known methods do not take account of the mass of tobacco. A particular mass having a particular moisture content will produce the same result as a smaller mass with a larger moisture content.

According to a first aspect of the present invention there is provided a method of determining the mass and moisture content of tobacco, comprising passing the tobacco between a pair of capacitor plates forming a test capacitor; applying an alternating current input signal to the test capacitor over a range of frequencies; monitoring a test signal (preferably the voltage across the test capacitor) which varies with the frequency of the applied input signal and exhibits a resonance frequency; and producing outputs indicative of the mass and moisture content of the tobacco derived from the resonance frequency and the magnitude of the test signal at a chosen frequency, preferably the resonance frequency.

This invention is particularly concerned with obtaining a rapid indication of the "dry mass" of the tobacco in a cigarette filler stream, as a means of controlling the amount of tobacco which is to be trimmed from the filler stream before it is enclosed in a wrapper to form a cigarette rod. The resonance frequency of the test signal may be determined from the magnitude or phase of the test signal, the input signal and the test signal being in phase and the magnitude of the test signal being a maximum at the resonance frequency.

The input signal is applied over a range of frequencies which are preferably above one mega-hertz (1 MHz), i.e. in the "radio frequency" range. In a preferred arrangement the frequency of the input signal is changed in finite steps and the test signal is monitored for each frequency applied. The range of frequencies applied may be cyclically repeated and confined within limits determined by a previously measured resonance frequency.

In a preferred arrangement the chosen frequency is the resonance frequency and quantities representing the resonance frequency and the magnitude of the test signal at the resonance frequency are processed in combination with pre-programmed data to produce outputs indicative of the absolute values for tobacco mass and moisture content. Alternatively, or in addition to the above, the magnitude of the test signal may be measured at a constant predetermined frequency, from which the dissipation product may be calculated. The dissipation product is a measure of the rate at which energy is dissipated by the capacitor.

According to a second aspect of the present invention there is provided a method of determining the mass and moisture content of tobacco, comprising passing the tobacco between a pair of capacitor plates forming a test capacitor; applying an alternating input signal to the test capacitance over a range of frequencies in which resonance occurs with respect to a test signal derived from the capacitor; and determining the mass of the tobacco from the resonance frequency, and the moisture content from the magnitude of the test signal at the resonance frequency. The resonance frequency varies with the mass and the moisture content and is therefore compensated for moisture content to give an indication of tobacco "dry mass".

According to a third aspect of the invention there is provided an apparatus for determining the mass and moisture content of tobacco, comprising means for passing the tobacco between a pair of capacitor plates forming a test capacitor; signal generating means arranged to apply an alternating input signal to the test capacitor over a range of frequencies; means arranged to monitor a test signal which varies with the frequency of the applied input signal and exhibits a resonance frequency; and means for producing outputs indicative of the mass and moisture content of the tobacco from the resonance frequency and the magnitude of the test signal at a chosen frequency.

Preferably the signal generating means consists of a variable frequency voltage source (arranged to generate an alternating voltage over a range of frequencies above 1 MHz) connected in series with an inductor. The voltage source may be controlled by a processing unit and may thereby supply alternating voltages over the range of frequencies in finite steps. Means may also be provided for measuring the voltage across the test capacitor (the test capacitor voltage) which preferably forms the test signal, and for applying a signal indicative of the capacitor voltage to the processing unit.

According to a fourth aspect of the present invention there is provided an apparatus for determining the mass and moisture content of tobacco in a cigarette making machine in which a trimming device trims tobacco held on a suction tape to form a filler stream, comprising two capacitor plates arranged on opposite sides of the filler stream and forming a filler capacitor; signal generating means arranged to apply an alternating input signal to the filler capacitor over a range of frequencies; means arranged to monitor a test signal which varies with the frequency of the applied input signal and exhibits a resonance frequency; and means for producing outputs indicative of the mass and moisture content of the tobacco from the resonance frequency and the magnitude of the test signal at a predetermined frequency.

In a preferred arrangement the trimming device is controlled in response to one of said outputs indicative of the mass of tobacco.

In cigarette making machines the filler stream is enclosed in a wrapper to form a continuous rod and the apparatus may further include a pair of capacitor plates placed on opposite sides of the continuous rod; means for determining the mass and moisture content of the tobacco enclosed in the rod; and means for comparing these values with the values obtained for the mass and moisture content of the tobacco forming the filler stream.

The apparatus may also comprise a nucleonic scanner for producing a scanner signal indicative of the mean tobacco mass; and means for combining the scanner signal with said outputs indicative of the mass and moisture content of the filler stream.

The invention will now be described, by way of example only, with reference to the accompanying figures of which:

Figure 1:
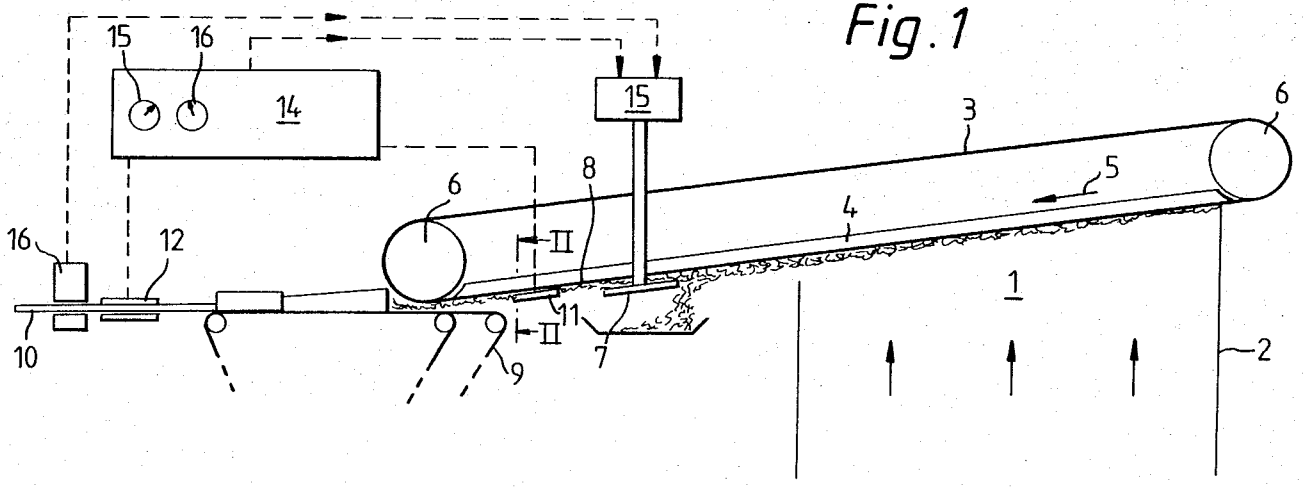
FIG. 1 shows a schematic representation of a cigarette making machine embodying apparatus in accordance with this invention.

In FIG. 1 a schematic representation of a cigarette making machine is shown, for example a Molins (Registered trade mark) Mk8 or Mk9 machine as described in British Pat. No. 929338. Tobacco 1 is fed from a hopper (not shown) up a chimney 2 and held on a suction tape 3 by suction applied by a suction chamber 4. The suction tape 3 is driven in the direction of arrow 5 by wheels 6 and carries tobacco on its underside past a trimming device 7. The trimming device removes excess tobacco while the tobacco remaining on the suction tape 3 forms a filler stream 8. A web of cigarette paper 9 is folded around the filler stream 8 and is sealed by a lap joint to form a continuous cigarette rod 10 which is subsequently cut into predetermined lengths.

The filler stream 8 passes between a first capacitor plate and a second capacitor plate which in combination form a filler capacitor 11. A second pair of capacitor plates are arranged one above and one below the enclosed rod, forming a rod capacitor 12. The filler capacitor 11 (in combination with its associated circuitry) determines the mass and moisture content of the tobacco before it is enclosed in cigarette paper 9, and the rod capacitor 12 (in combination with its associated circuity) determines these parameters for the enclosed rod. By using two capacitors arranged in this way, an indication may be provided of the effect on the moisture content of operations required to form the rod, for example, heat applied to seal the lap joint.

A control means 14 controls the trimmer height (via a trimmer controller 15) to adjust the amount of tobacco in a unit length of the cigarette rod in a response to the mass and moisture content determined by the capacitors. The moisture content of tobacco in the hopper may also be controlled in response to a signal from the control means 14, although experiments indicate that a difference of 2% in the moisture content is required before effective correction can be made.

A nucleonic scanner 16 (for example, a Molins "Molic" as described in British Pat. No. 1342064) also provides a signal to the trimmer controller 15. The nucleonic scanner gives an accurate indication of the average mass whereas the measurements obtained from the filler capacitor and the rod capacitor provide a fast response to local mass variations.

The rod capacitor 12 is shown with one plate above the tobacco rod and one plate below, while the filler capacitor 11 is shown with horizontally spaced plates on either side of the filler stream 8; each of these arrangements being suitable for either application.

Figure 2:
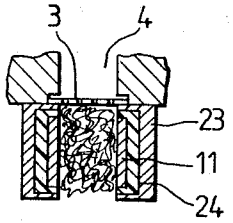
FIG. 2 is a section of line II—II of FIG. 1.

A cross section on line II—II is shown in FIG. 2 detailing the arrangement of the filler capacitor 11. The filler stream 8 passes between side supports 23 each having a capacitor plate set into its inside face.

Figure 3:
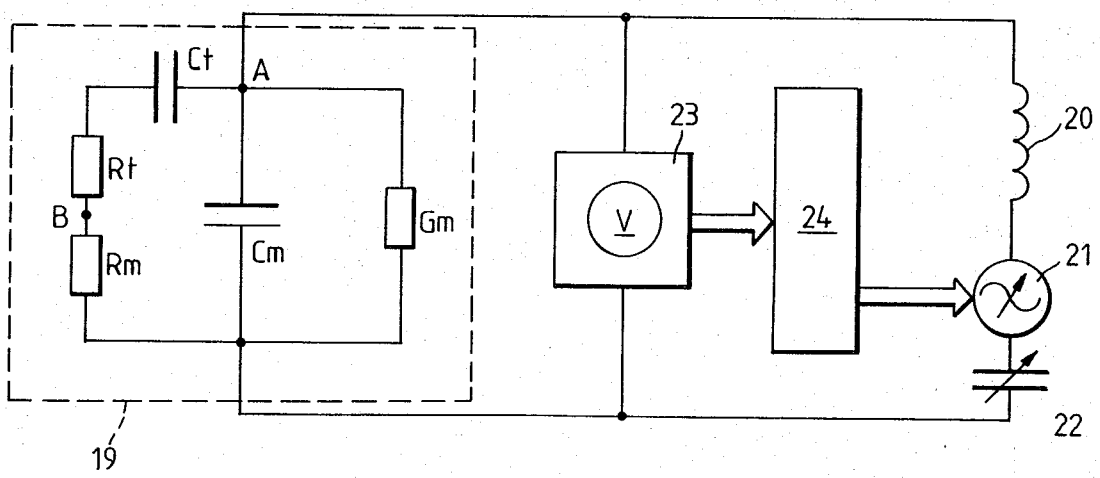
FIG. 3 shows a circuit for use with a measuring capacitor in which the measuring capacitor is represented by a theoretical equivalent circuit.

A test capacitor (represented by an equivalent circuit 19) and its associated circuitry is shown in FIG. 3 in which:

$C_T$—capacitance due to tobacco only $R_T$—resistive losses due to tobacco only $C_M$—capacitance due to moisture $R_M$—resistive losses due to moisture absorbed by tobacco $G_M$—conductance due to moisture on the surface of the tobacco The equivalent circuit for the test capacitor may be simplified to the elements between points A and B when considering dry tobacco; that is because $R_M$, $G_M$ and $C_M$ are then virtually zero.

The test capacitor is connected in series with an inductor 20 and a variable frequency voltage source 21, thus forming a series resonance circuit. A variable capacitor 22 is also connected in series to facilitate zeroing the apparatus. The voltage across the capacitor is monitored by a suitable voltage measuring device 23 which applies a digital representation of said voltage to a processing unit 24. The processing unit consists of a microprocessor with associated memory and interface lines for receiving signals from the voltage measuring device 23 and applying signals to the variable frequency voltage source 21—thereby controlling its frequency.

The processing unit 24 is programmed to apply a range of signals to the voltage source which in turn applies a voltage to the rest of the circuit over a range of frequencies above 1 MHz and preferably between 10 MHz and 50 MHz. On initiating the system the voltage source 21 (controlled by the processing unit) applies a voltage to the circuit at a frequency of 75% of the expected average resonance frequency retained by the processor. The circuit oscillates at the applied frequency and the processing unit reads and stores the digital representation of the capacitor voltage. The signal applied to the voltage source is then swept or incremented through a range of frequencies up to 125% of the expected resonance frequency, the capacitor voltage at each frequency being read and stored. The true resonance frequency is then calculated by a suitable algorithm or alternatively the resonance frequency is calculated while measurements are being made thus reducing the memory requirement. There may be provision for automatically adjusting the midpoint of the range of frequencies swept by the circuit in the event of the resonance frequency undergoing a significant change.

The test capacitor is not solely capacitive and the voltage across the test capacitor will have a loss angle d (delta). The processing unit is therefore arranged to calculate the capacitance C, loss factor (tan d) and the dissipation product ($E^2$ wC tan d). In the above equation E is the voltage across the capacitor and w (omega) is its frequency (in radians per second). These results are then compared with pre-programmed data (originally established experimentally) relating to the particular type of tobacco being used to accommodate for its particular characteristics. For example, a tobacco containing a particular additive may have a different response than a tobacco without such an additive. Experiments have shown the following general relationships which provide a basis for determining mass and moisture content from the measured and calculated parameters.

1. The loss factor varies with mass due to moisture and is independent of mass due to tobacco.

2. The capacitance varies with the total mass but is approximately ten times more sensitive to changes of mass due to moisture than changes of mass due to tobacco.

3. Capacitance varies with the total mass having a constant percentage moisture content but is less sensitive if no moisture is present.

4. The dissipation product varies with the total mass but is approximately forty times more sensitive to changes of the mass due to moisture than changes of mass due to tobacco.

In an alternative mode of operation the processing unit 24 is arranged to process the information in a comparative way—a change in voltage across the capacitor at the resonance frequency indicating a change in the moisture content and a change in the resonance frequency (when compensated for changes in moisture content) indicating a change in the tobacco dry mass.

In this mode the processing unit 24 cannot provide an output indicative of absolute values for tobacco mass and moisture content but can indicate changes in these parameters. Such changes may then control the trimming device 7 with or without extra control signals from the nucleonic scanner 16. Alternatively the processing unit 24 may combine signals from the nucleonic scanner with capacitance signals to give absolute values for mass and moisture content.

In addition to these possible arrangements a moisture content probe (for example a micro-wave absorption probe) could be installed in the hopper and its results compared with those obtained according to this invention. The comparison would give an indication of moisture changes during the rod making process.

A visual display may be provided on the cigarette making machine to show the running means of the tobacco moisture content in the hopper and in the filler stream, possibly with an indication of the difference between those two measurements.

I claim:

1. A method of determining the mass and moisture content of tobacco, comprising passing said tobacco between a pair of capacitor plates forming a test capacitor; applying an alternating circuit input signal to said test capacitor at a varying frequency which changes rapidly over a range of frequencies including a frequency at which there is a resonance condition; monitoring a test signal which varies in amplitude in dependence upon the frequency of said input signal and exhibits said resonance condition; and producing outputs indicative of the mass and moisture content of said tobacco derived from the resonance frequency and the magnitude of the test signal at a chosen frequency.

2. A method according to claim 1 in which the frequency of said input signal extends over a range above 1 MHz.

3. A method according to claim 1 in which the frequency of said input signal is changed in finite steps and said test signal is monitored for each of said frequencies.

4. A method according to claim 1 in which said range of frequencies of said test signal is cyclically repeated and is confined within limited determined by a previously measured resonance frequency.

5. A method according to claim 1 in which the chosen frequency is the resonance frequency.

6. A method according to claim 5 in which quantities representing the resonance frequency of said test signal and the magnitude of said test signal at its resonance frequency are processed in combination with pre-programmed data to produce outputs indicative of the absolute values for tobacco mass and moisture content.

7. A method according to claim 1 in which the chosen frequency is constant, and the magnitude of the test signal at said constant frequency is indicative of the dissipation product.

8. A method of determining the mass and moisture content of tobacco, comprising passing said tobacco between a pair of capacitor plates forming a test capacitor; applying an alternating input signal to said test capacitance at a varying frequency changing rapidly in a continuous cyclic manner over a range of frequencies at which a resonance condition occurs with respect to a test signal derived from the capacitor; and determining the mass of the tobacco from said resonance frequency, and the moisture content from the magnitude of said test signal at said resonance frequency.

9. Apparatus for determining the mass and moisture content of tobacco, comprising means for passing said tobacco between a pair of capacitor plates forming a test capacitor; signal generating means for applying to said test capacitor an alternating current input signal which varies rapidly in frequency in a continuous cyclic manner over a range of frequencies so as to produce a test signal which varies with the frequency of said input signal and exhibits a resonance frequency; and means for producing outputs indicative of the mass and moisture content of said tobacco from the resonance frequency and the magnitude of said test signal at a chosen frequency.

10. Apparatus according to claim 9 in which said signal generating means consists of a variable frequency voltage source arranged to generate an alternating voltage over a range of frequencies above 1 MHz connected in series with an inductor.

11. Apparatus according to claim 10 in which said voltage source is arranged to supply said alternating voltage over a range of frequencies in finite steps controlled by a processing unit.

12. Apparatus according to claim 11 in which said test signal is the test capacitor voltage, and in which the apparatus includes means for measuring said test capacitor voltage and means for applying a signal indicative of said test capacitor voltage to said processing unit.

13. Apparatus for determining the mass and moisture content of tobacco in a cigarette making machine in which a trimming device trims tobacco held on a suction tape to form a filler stream, comprising two capacitor plates, arranged on opposite sides of the filler stream and forming a filler capacitor; signal generating means for applying to the filler capacitor and alternating current input signal which varies rapidly in frequency in a continuous cyclic manner over a range of frequencies so as to produce a test signal which varies with the frequency of said input signal and exhibits a resonance frequency; and means for producing outputs indicative of the mass and moisture content of the tobacco from the resonance frequency and the magnitude of said test signal at a chosen frequency.

14. Apparatus according to claim 13 in which said output producing means is connected to said trimming device so that said trimming device is controlled in response to one of said output signals which is indicative of the mass of tobacco.

15. Apparatus for determining the mass and moisture content of tobacco in a cigarette making machine in which a trimming device trims tobacco held on a suction tape to form a filler stream, comprising two capacitor plates, arranged on opposite sides of the filler stream and forming a filler capacitor; signal generating means arranged to apply an alternating input signal to the filler capacitor over a range of frequencies such as to produce a test signal which varies with the frequency of said input signal and exhibits a resonance frequency; and means for producing outputs indicative of the mass and moisture content of the tobacco from the resonance frequency and the magnitude of said test signal at a chosen frequency, in which said filler stream is enclosed in a wrapper to form a continuous cigarette rod, further comprising a pair of capacitor plates on opposite sides of the continuous rod; means for determining the mass and moisture content of the tobacco enclosed in the rod; and means for comparing these values with values obtained for the mass and moisture content of the tobacco forming the filler stream.

16. Apparatus for determining the mass and moisture content of tobacco in a cigarette making machine in which a trimming device trims tobacco held on a suction tape to form a filler stream, comprising two capacitor plates, arranged on opposite sides of the filler stream and forming a filler capacitor; signal generating means arranged to apply an alternating input signal to the filler capacitor over a range of frequencies such as to produce a test signal which varies with the frequency of said input signal and exhibits a resonance frequency; and means for producing outputs indicative of the mass and moisture content of the tobacco from the resonance frequency and the magnitude of said test signal at a chosen frequency, in which the filler stream is enclosed in a wrapper to form a continuous rod further comprising a nucleonic scanner for producing a scanner signal indicative of the tobacco mass in the cigarette rod and means for controlling the position of said trimmer in response both to said scanner signal and to the signal which is derived from said filler capacitor and is indicative of mass.

17. Apparatus for controlling the mass of tobacco in a cigarette rod produced by a cigarette making machine in which a trimming device trims tobacco held on a suction tape to form a filler stream, the filler stream is enclosed in a wrapper to form a continuous cigarette rod and a nucleonic scanner produces a scanner signal indicative of the mass of tobacco in the rod, comprising two capacitor plates arranged on opposite sides of the filler stream and forming a filler capacitor; signal generating means for applying to said filler capacitor an alternating current input signal which varies rapidly in frequency in a continuous cyclic manner over a range of frequencies so as to produce a test signal which varies with the frequency of the applied input signal and exhibits a resonance frequency; means for monitoring the said test signal; means for producing a filler signal dependent upon the resonance frequency and upon the magnitude of said test signal at said resonance frequency; and means for controlling the trimmer device in response to said filler signal and said scanner signal.

* * * * *